United States Patent [19]

Brady et al.

[11] Patent Number: 4,478,869

[45] Date of Patent: Oct. 23, 1984

[54] APPLYING GRANULES TO STRIP ASPHALTIC MATERIAL

[75] Inventors: Thomas R. Brady; Lester C. Benner, both of Newark, Ohio

[73] Assignee: Owens-Corning Fiberglas Corporation, Toledo, Ohio

[21] Appl. No.: 455,097

[22] Filed: Jan. 3, 1983

[51] Int. Cl.[3] ..... B05D 5/02

[52] U.S. Cl. ..... 427/10; 427/9; 427/186; 427/188; 427/345; 118/308; 118/312; 118/668; 118/688; 222/56; 222/64; 222/71

[58] Field of Search ..... 222/1, 55–57, 222/59, 64, 71, 318, 52, DIG. 1; 118/308, 312, 688, 691, 694, 663, 668; 427/8, 10, 9, 186, 188, 345

[56] References Cited

U.S. PATENT DOCUMENTS

| | | | |
|---|---|---|---|
| 1,669,166 | 5/1928 | Keller | 118/312 X |
| 2,661,303 | 12/1953 | Fasold et al. | 427/188 X |
| 2,940,422 | 6/1960 | Dott | 118/312 |
| 3,801,349 | 4/1974 | Wilson et al. | 427/10 |
| 4,313,343 | 2/1982 | Kobayashi et al. | 118/694 X |
| 4,406,247 | 9/1983 | Baughman et al. | 222/71 X |

*Primary Examiner*—Stanley H. Tollberg
*Assistant Examiner*—Kevin P. Shaver
*Attorney, Agent, or Firm*—Ronald C. Hudgens; Philip R. Cloutier; Ted C. Gillespie

[57] ABSTRACT

A method and apparatus for applying granules to continuously moving strip asphaltic material comprises discharging granules onto tacky strip asphaltic material, continuously removing the non-adhered portion of the granules, sensing the amount of removed granules, and controlling the amount of granules discharged onto the asphaltic material in response to the sensed amount of removed granules.

13 Claims, 4 Drawing Figures

APPLYING GRANULES TO STRIP ASPHALTIC MATERIAL

TECHNICAL FIELD

This invention pertains to the handling of continuous strips of asphaltic material, such as asphaltic material suitable for use as roofing membranes and roofing shingles. In one of its more specific aspects, this invention relates to controlling the application of granules to asphaltic strip material.

BACKGROUND OF THE INVENTION

A common method for the manufacture of asphalt shingles is the production of a continuous strip of asphaltic shingle material followed by a shingle cutting operation which cuts the material into individual shingles. In the production of asphaltic strip material, either an organic felt or a glass fiber mat has passed through a coater, containing liquid asphalt at a very hot temperature, to form a tacky coated asphaltic strip. Subsequently, the hot asphaltic strip is passed beneath one or more granule applicators which apply the protective surface granules to portions of the asphaltic strip material. Typically, the granules are dispensed from a hopper at a rate which can be controlled by making manual adjustments on the hopper. In the manufacture of colored shingles, two types of granules are employed. Headlap granules are granules of relatively lower cost for portions of the shingle which are to be covered up. Colored granules are of relatively higher cost and are applied to the portion of the shingle which will be exposed on the roof. A typical shingle manufacturing process continuously manufactures the shingle material in a width sufficient for cutting the material into three shingles.

Not all of the granules applied to the hot, tacky, coated asphaltic strip adhere to the strip, and, typically, the strip material is turned around a slate drum to invert the strip and cause the non-adhered granules to drop off. These non-adhered granules, which are known as backfall granules, are usually collected in a backfall hopper. The backfall granules are discharged at a set rate from the backfall hopper onto the strip material.

One of the problems associated with such granule application procedures is that there is no control, other then manual control, of the rate at which the granules are discharged from the headlap hopper, the colored granule hopper, and the backfall hopper. Also, in the event too many or too few granules are being discharged from the headlap hopper or the colored granule hopper, there is no method or means for correcting that condition other than human observation.

The present invention solves the above problem by providing means for sensing the amount of non-adhered granules and controlling the application of granules in response to the sensed amount of non-adhered granules.

SUMMARY OF THE INVENTION

According to this invention, there is provided apparatus for applying granules to continuously moving asphaltic strip material comprising means for discharging granules onto tacky strip asphaltic material, means for continuously removing the non-adhered portion of the granules, means for sensing the amount of removed granules, and means for controlling the amount of granules discharged from the means for discharging in response to the sensed amount of removed granules. The means for controlling the amount of granules discharged can be an automatically controlled gate on the headlap hopper, the colored granule hopper, or the backfall hopper itself, or any combination of these hoppers. Thus, the process can be automatically controlled to discharge specific amounts of granules in response to the amount of granules not adhering to the tacky asphaltic strip.

In a specific embodiment of the invention, the means for removing the non-adhered granules comprising a drum and a backfall hopper.

In another specific embodiment of the invention, the means for sensing comprises means for sensing the level of granules in the backfall hopper, such as a sonic means.

In another specific embodiment of the invention, the means for sensing comprises means for sensing the flow of non-adhered granules at a location adjacent the drum. A light emitter can be employed to direct the light signal toward a locus on the drum, and a light receiver, such as a photocell, can be used to receive the light reflected from the drum at the locus.

According to this invention, there is also provided a method for applying granules to continuously moving asphaltic strip material comprising discharging granules onto tacky strip asphaltic material, continuously removing the non-adhered portion of the granules, sensing the amount of removed granules, and controlling the amount of granules discharged onto the asphaltic material in response to the sensed amount of removed granules.

In a preferred embodiment of the invention, the asphaltic material is directed around a drum to remove the non-adhered portion of the granules.

In another specific embodiment of the invention, the non-adhered granules are collected in a backfall hopper.

In another specific embodiment of the invention, the sensing step comprises sensing the level of granules in the backfall hopper.

In another specific embodiment of the invention, the level of the granules in the backfall hopper is sensed with a sonic means.

In another specific embodiment of the invention, the sensing step comprises sensing the flow of granules at a location adjacent a locus on the drum. A light signal can be directed toward the locus, and the light reflected from the drum at the locus can be received. The amount of light reflected is dependent upon the amount of granules flowing past the locus, since the granules block a portion of the light and do not reflect the light to the same extent as does the shiny slate drum.

DESCRIPTION OF THE INVENTION

Figure 1:
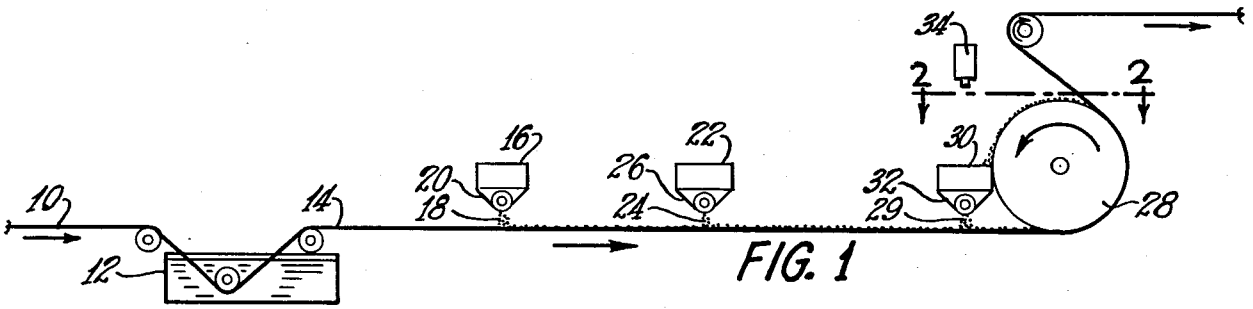
FIG. 1 is a schematic cross-sectional view in elevation of apparatus for applying granules to asphaltic strip material according to the principles of this invention.

As shown in FIG. 1, base sheet 10, which can be an organic felt or a glass fiber mat, is passed through coater 12 containing liquid asphalt to create continuous hot strip 14 of asphaltic material. The tacky coated strip is then passed beneath headlap hopper 16 for the application of headlap granules 18. The headlap hopper can be adapted with any suitable means for controlling the output from the hopper, such as headlap gate 20. Headlap granules can be supplied to the headlap hopper from a source by any suitable means not shown. In the manufacture of colored shingles, the coated strip, which is in a tacky condition, is then passed beneath colored granule hopper 22, which deposits colored granules 24 onto the tacky strip material. Colored granules can be supplied to the hopper from a source of colored granules by any suitable means, not shown. The colored granule hopper can be adapted with any suitable control means for controlling the flow of granules therefrom, such as colored granule gate 26. In a typical granule coating operation, all of the surface of the asphaltic strip material is covered by granules from either the headlap hopper or the colored granule hopper.

After being covered with granules, the asphaltic strip material is passed around apparatus for removing the non-adhered granules from the strip material. Preferably, the means for removing the non-adhered granules is a drum, such as slate drum 28, around which the strip material passes, thereby inverting the strip material and causing the non-adhered or backfall granules 29 to fall off. The backfall granules travel along the slate drum and are collected in any suitable means, preferably in a hopper such as backfall hopper 30. The backfall hopper can be adapted with a means for discharging the backfall granules, such as backfall hopper gate 32.

The amount of backfall granules being removed from the asphaltic material is sensed. The means for sensing the amount of backfall granules can be a sensor for detecting the level of granules in the backfall hopper, such as level sensor 34. Preferably, the level sensor is a sonic device, such as a Polaroid Ultrasonic Ranger, by the Polaroid Corporation. The sensing of the level of granules in the hopper can be accomplished with other devices, such as level-contacting devices, not shown.

Figure 3:
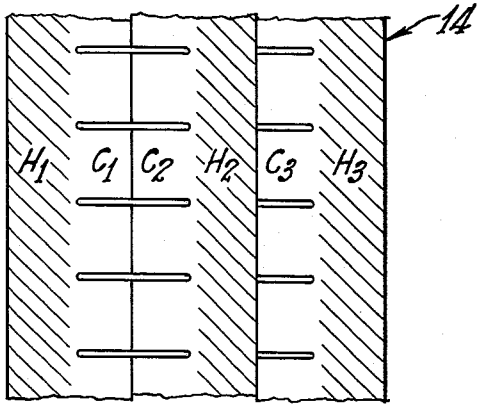
FIG. 3 is a schematic plan view of a portion of the asphaltic strip material having been coated with the granules.

As shown in FIG. 3, the strip material can be divided into six lanes, with a headlap lane and a colored granule lane making up one shingle. Thus, three shingles can be manufactured simultaneously. The labels $H_1$, $H_2$, and $H_3$ refer to the three headlap lanes of the three shingles being manufactured. The labels $C_1$, $C_2$l, and $C_3$ refer to the three lanes of colored granules for the three shingles, respectively.

Figure 4:
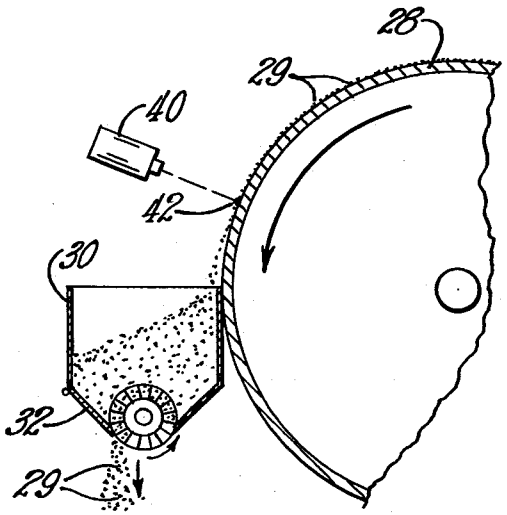
FIG. 4 is a schematic view in elevation of the slate drum and backfall hopper along line 4—4 of FIG. 2.
Figure 2:
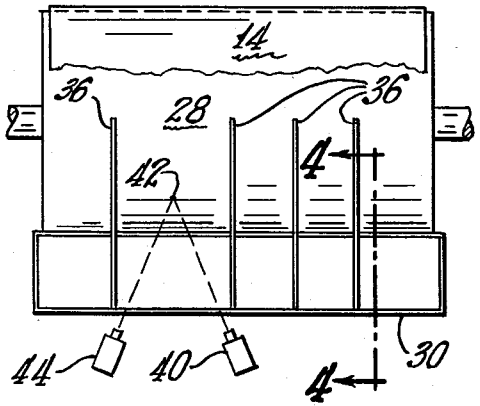
FIG. 2 is a schematic plan view of the slate drum and backfall hopper along line 2—2 in FIG. 1, illustrating another means for sensing the amount of granules flowing past a locus on the drum.

As shown in FIG. 2, the drum can be adapted with dividers, such as slate drum dividers 36, to separate the backfall granules into compartments in the backfall hopper, thereby preventing contamination between the headlap granules and the colored granules. FIGS. 2 and 4 illustrate a means for sensing the amount of backfall granules which comprises a signal source and a signal receiver. The signal source, preferably a light source, can be any means for directing a signal toward the slate drum, such as illuminator 40. Preferably, the illuminator is a Fiber-Lite, High Intensity Illuminator, model 170-D, manufactured by Dolan-Jenner Industries, Inc., Woburn, Mass. The illuminator directs a light signal toward a locus on the slate drum, such as reflection point 42. The reflected light is received by any suitable means for receiving the signal, such as photoelectric cell 44. A suitable photoelectric cell is one manufactured by International Rectifier Corporation, model DP-2.

In operation, the amount of backfall granules is sensed by any one of the means suitable, such as by sonic sensor 34. In response to the sensed level of granules in the hopper, the headlap hopper gate and the colored granule hopper gate are controlled by any suitable means, such as a solenoid, to discharge granules at a rate in response to the sensed amount of excess granules. Also, with the backfall hopper being divided into compartments to prevent contamination between the colored granules and the headlap granules, separate sensors can be employed to sense the amounts of colored backfall granules and headlap backfall granules, respectively, and to control the colored granule gate, headlap granule gate, or backfall hopper gate, as is desired.

It will be evident from the foregoing that various modifications can be made to this invention. Such, however, are considered as being within the scope of the invention.

INDUSTRIAL APPLICABILITY

This invention will be found to be useful in the continuous production of asphaltic strip material for such uses as asphalt shingles.

We claim:

1. Apparatus for applying granules to continuously moving asphaltic strip material comprising means for discharging granules onto tacky strip asphaltic material, means for continuously removing the non-adhered portion of the granules, means for sensing the amount of removed granules, and means for controlling the amount of granules discharged from said means for discharging in response to the sensed amount of removed granules.

2. The apparatus of claim 1 in which said means for removing comprises a drum and a backfall hopper.

3. The apparatus of claim 2 in which said means for sensing comprises means for sensing the level of granules in said backfall hopper.

4. The apparatus of claim 3 comprising a sonic means for sensing the level of granules.

5. The apparatus of claim 2 comprising means for sensing the flow of granules at a location adjacent a locus on said drum.

6. The apparatus of claim 5 comprising a light emitter for directing a light signal toward said locus and a light receiver for receiving the light reflected from said drum at said locus.

7. A method for applying granules to continuously moving asphaltic strip material comprising discharging granules onto tacky strip asphaltic material, continuously removing the non-adhered portion of the granules, sensing the amount of removed granules, and controlling the amount of granules discharged onto said asphaltic material in response to the sensed amount of removed granules.

8. The method of claim 7 comprising directing said asphaltic material around a drum to remove said non-adhered portion.

9. The method of claim 8 comprising collecting said non-adhered portion in a backfall hopper.

10. The method of claim 9 in which the sensing step comprises sensing the level of granules in said backfall hopper.

11. The method of claim 10 comprising sensing the level with a sonic means.

12. The method of claim 8 in which the sensing step comprises sensing the flow of granules at a location adjacent a locus on said drum.

13. The method of claim 12 comprising directing a light signal toward said locus and receiving the light reflected from said drum at said locus.

* * * * *